US011659931B1

(12) United States Patent
Chen et al.

(10) Patent No.: US 11,659,931 B1
(45) Date of Patent: May 30, 2023

(54) FOLDABLE CHAIR

(71) Applicant: Te-Lung Chen, Tainan (TW)

(72) Inventors: Te-Lung Chen, Tainan (TW); Pin-Yi Chen, Tainan (TW); Pin-Han Chen, Tainan (TW)

(73) Assignee: Te-Lung Chen, Tainan (TW)

( * ) Notice: Subject to any disclaimer, the term of this patent is extended or adjusted under 35 U.S.C. 154(b) by 0 days.

(21) Appl. No.: 17/684,518

(22) Filed: Mar. 2, 2022

(51) Int. Cl.
*A47C 4/28* (2006.01)

(52) U.S. Cl.
CPC ..... *A47C 4/286* (2013.01)

(58) Field of Classification Search
CPC ..... A47C 4/286
USPC ..... 297/45
See application file for complete search history.

(56) References Cited

U.S. PATENT DOCUMENTS 6,179,374 B1 * 1/2001 Tang ..... A47C 4/286 297/42
6,296,304 B1 * 10/2001 Zheng ..... A47C 4/286 297/376
6,840,574 B1 * 1/2005 Wu ..... A47C 4/283 297/45
7,758,111 B2 * 7/2010 Chen ..... A47C 4/286 297/16.2
8,303,032 B1 * 11/2012 Platta ..... A47C 4/286 297/183.5
2003/0052518 A1 * 3/2003 Zheng ..... A47C 4/286 297/16.2
2003/0071493 A1 * 4/2003 Miyagi ..... A47C 4/286 297/16.2

* cited by examiner

*Primary Examiner* — Anthony D Barfield
(74) *Attorney, Agent, or Firm* — Muncy, Geissler, Olds & Lowe, P.C.

(57) ABSTRACT

A foldable chair includes a chair back unit, two side leg units, a chair cover unit, a foldable rod unit, and a linking rod unit. The chair back unit includes back rods that extends in a top-bottom direction. The chair cover unit has ends secured to the side leg units, and other ends respectively and slidably sleeved on the back rods. The foldable rod unit is pivotally connected between the back rods and is operable to move the back rods toward or away from each other. The linking rod unit includes an end that is pivotally connected to the foldable rod unit, and another end that is pivotally connected to the chair back unit.

8 Claims, 13 Drawing Sheets

FOLDABLE CHAIR

FIELD

The disclosure relates to a chair, and more particularly to a foldable chair.

BACKGROUND

FIGS. 1 to 3 illustrate a conventional foldable chair. The conventional foldable chair includes a backrest unit 11, two side leg units 12 spaced apart from each other in a left-right direction and pivotally connected to the backrest unit 11, a chair cover unit 13 secured to the backrest unit 11 and the side leg units 12, and a front leg unit 14 disposed in front of the backrest unit 11.

The backrest unit 11 includes two backrest posts 111 that are spaced apart from each other in the left-right direction and extending in a top-bottom direction perpendicular to the left-right direction, and two back scissor legs 112 that are arranged in the front-rear direction and that are crossed over and pivotally connected to each other. Each of the side leg units 12 includes two side scissor legs 121 that are arranged in the left-right direction and that are crossed over and pivotally connected to each other. The front leg unit 14 includes two front scissor legs 141 that are arranged in the front-rear direction and that are crossed over and pivotally connected to each other.

As shown in FIGS. 1 to 4, the conventional foldable chair can be operated between a stretched state (see FIGS. 1 to 3) and a folded state (see FIG. 4).

However, to operate the conventional foldable chair to change between the stretched and folded states, a user has to move the backrest unit 11, the side leg units 12, and the front leg unit 14 respectively for folding or unfolding the back scissor legs 112, the side scissor legs 121, and the front scissor legs 141, and this is rather inconvenient.

SUMMARY

Therefore, an object of the disclosure is to provide a foldable chair that can alleviate the drawback of the prior art.

According to the disclosure, a foldable chair includes a chair back unit, two side leg units, a chair cover unit, a foldable rod unit, and at least one linking rod unit.

The chair back unit includes two back rod sets spaced apart from each other in a left-right direction. Each of the back rod sets has a back rod that extends in a top-bottom direction perpendicular to the left-right direction, an upper sleeve that is slidably sleeved on the back rod, and a lower sleeve that is sleeved on a bottom end of the back rod.

The side leg units are spaced apart from each other in the left-right direction. Each of the side leg units includes first and second scissor legs that are arranged in the left-right direction and that are crossed over and pivotally connected to each other, a bottom pivot seat that is disposed in front of the lower sleeve of a respective one of the back rod sets, and an upper pivot seat that is disposed in front of the upper sleeve of the respective one of the back rod sets. The first scissor leg has opposite top and bottom ends that are pivotally and respectively connected to the upper sleeve of the respective one of the back rod sets and the bottom pivot seat. The second scissor leg has opposite top and bottom ends that are pivotally and respectively connected to the upper pivot seat and the lower sleeve of the respective one of the back rod sets.

The chair cover unit includes a seat cover that has left and right front ends respectively secured to the upper pivot seats of the side leg units, and left and right rear ends respectively disposed above the upper sleeves of the back rod sets and respectively and slidably sleeved on the back rods of the back rod sets.

The foldable rod unit is pivotally connected between the back rods of the back rod sets and is operable to move the back rods of the back rod sets toward or away from each other.

The at least one linking rod unit has an end that is pivotally connected to the foldable rod unit, and another end that is pivotally connected to the chair back unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
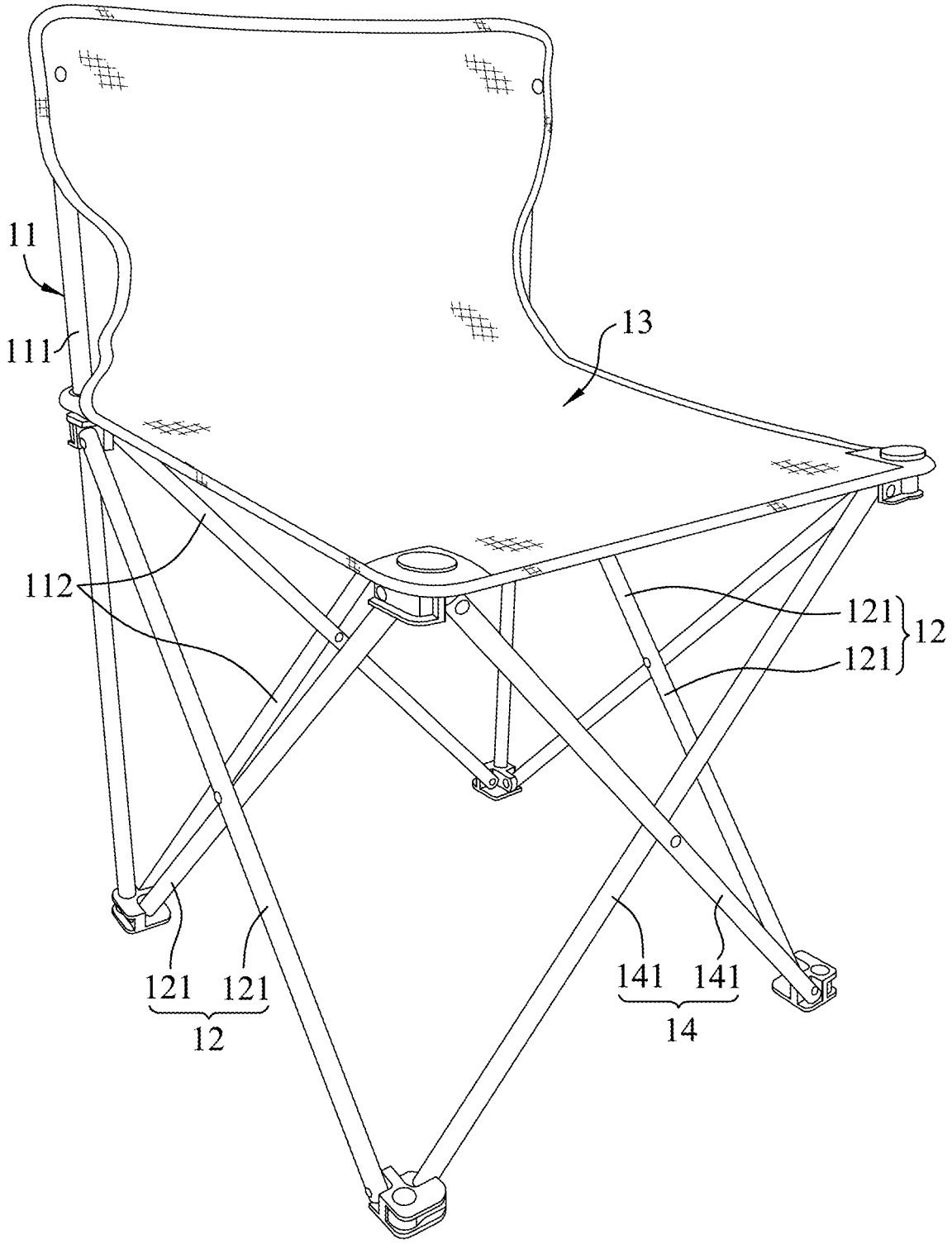
FIG.1 PRIOR ART
FIG. 1 is a perspective view illustrating a conventional foldable chair.
Figure 2:
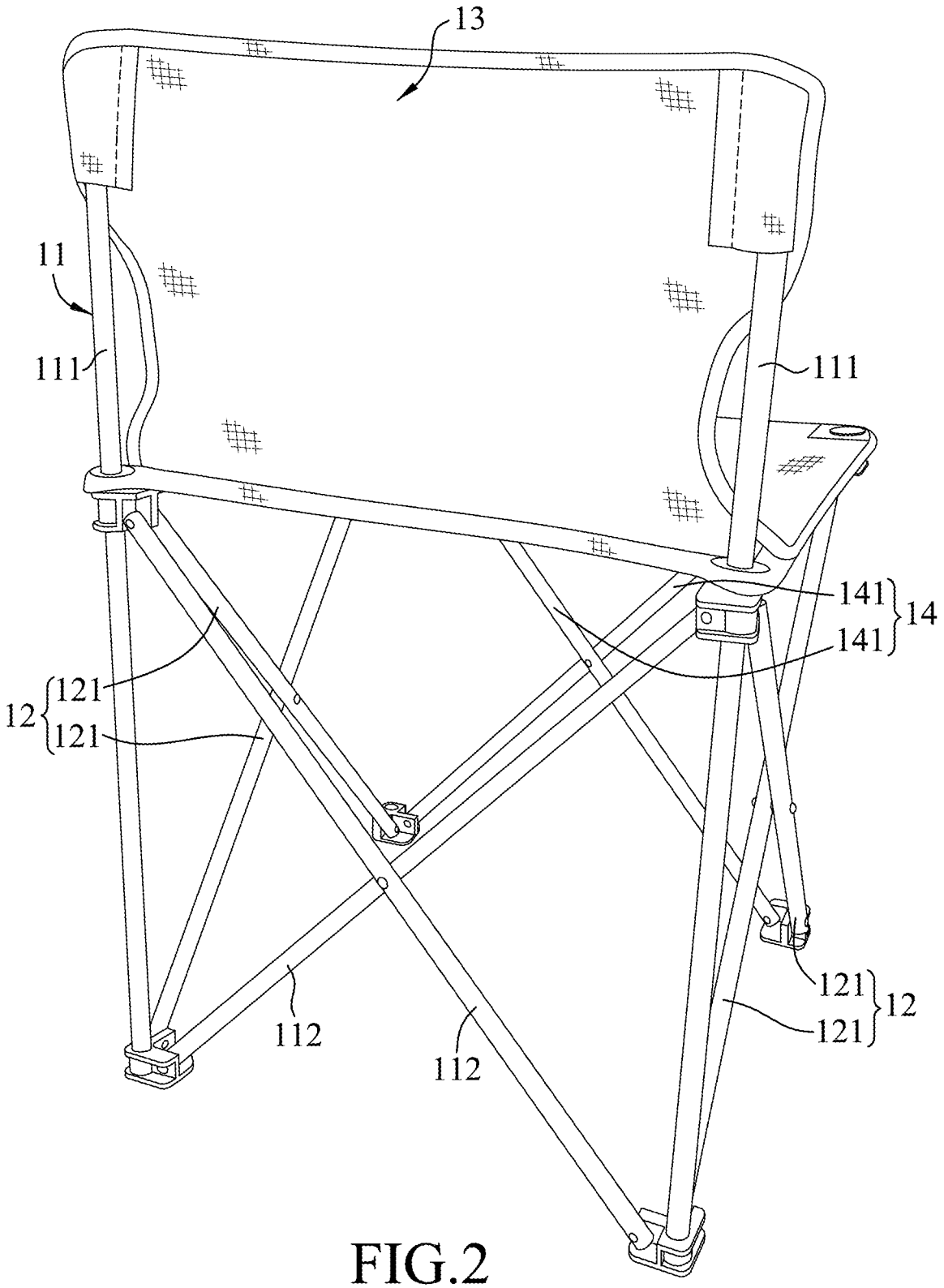
FIG.2 PRIOR ART
FIG. 2 is a perspective view of the conventional foldable chair viewed from a different angle.
Figure 3:
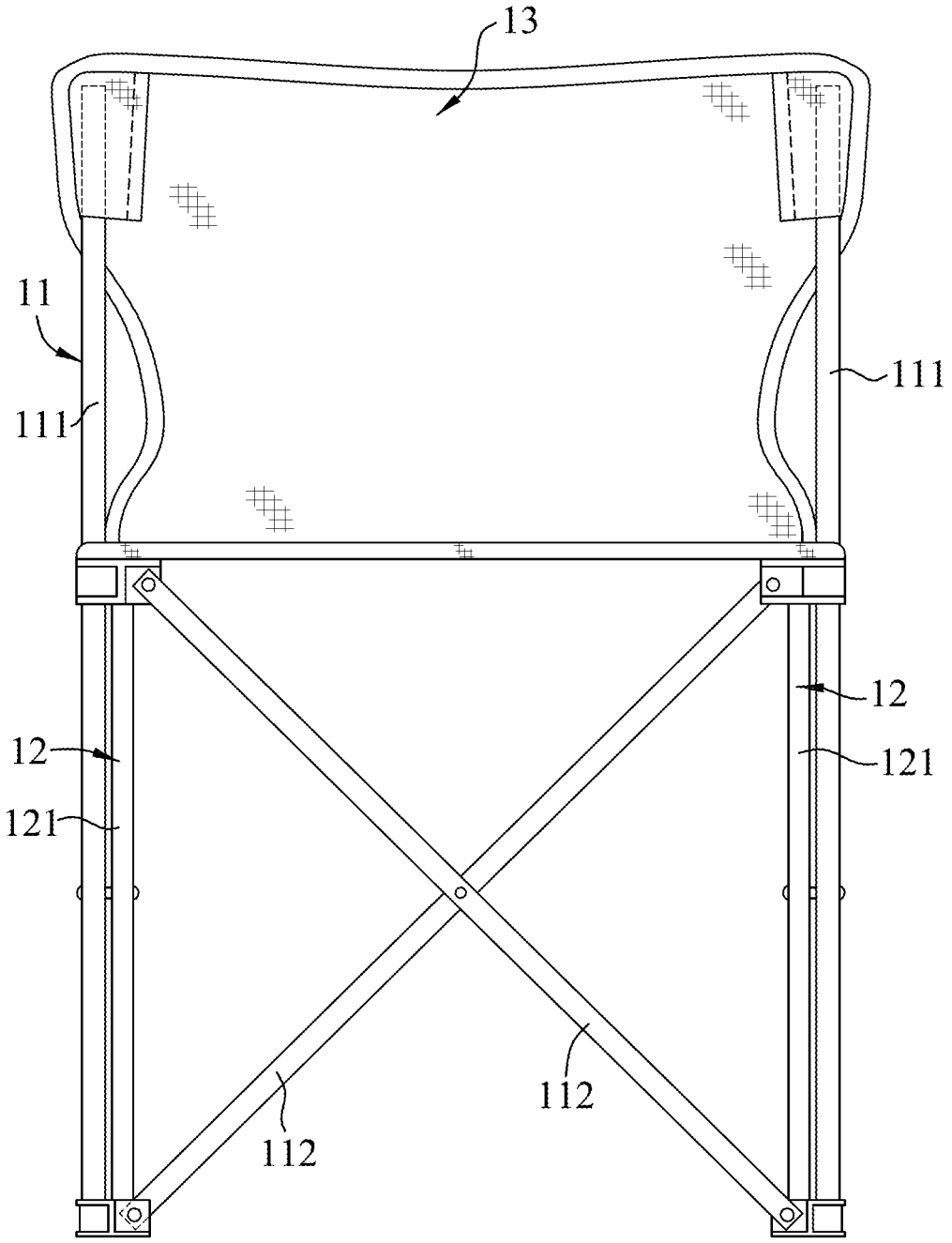
FIG.3 PRIOR ART
FIG. 3 is a rear view of the conventional foldable chair in a stretched state.
Figure 4:
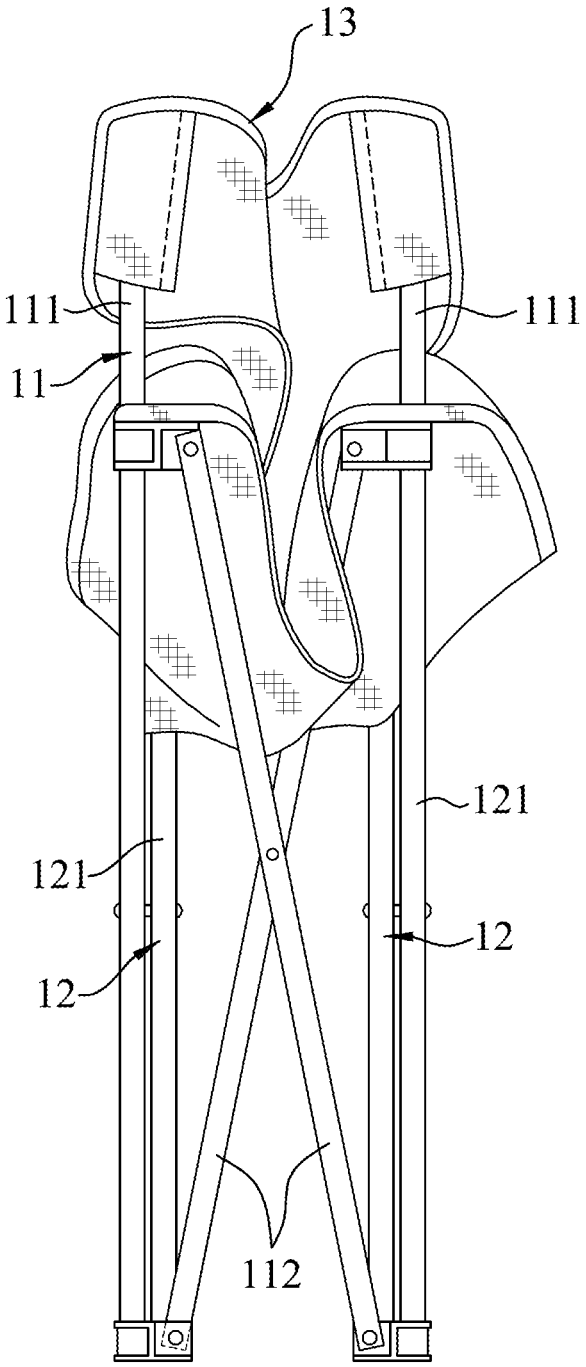
FIG.4 PRIOR ART
FIG. 4 is a rear view of the conventional foldable chair in a folded state.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 5:
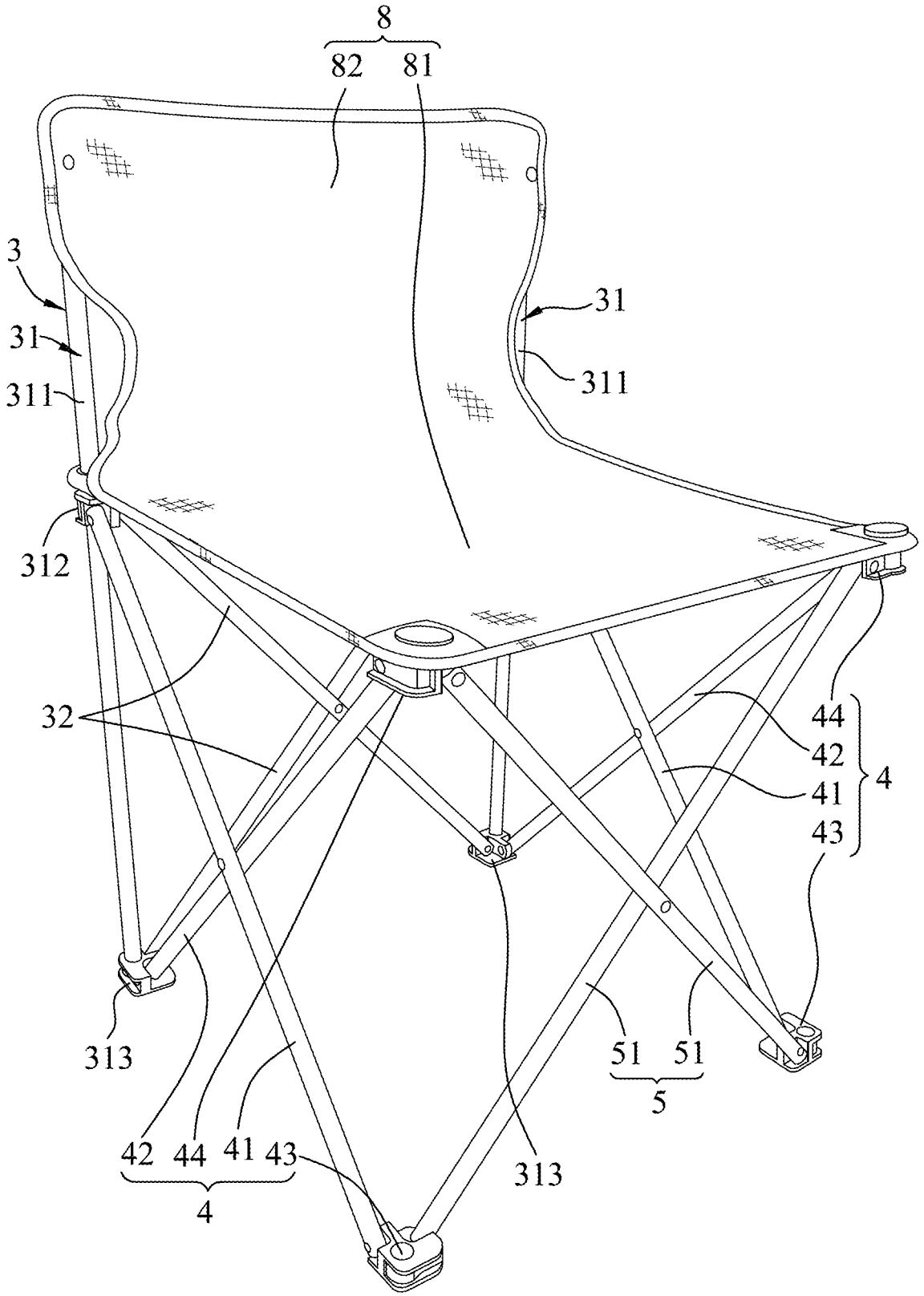
FIG. 5 is a perspective view illustrating a foldable chair according to a first embodiment of the disclosure in a stretched state.
Figure 6:
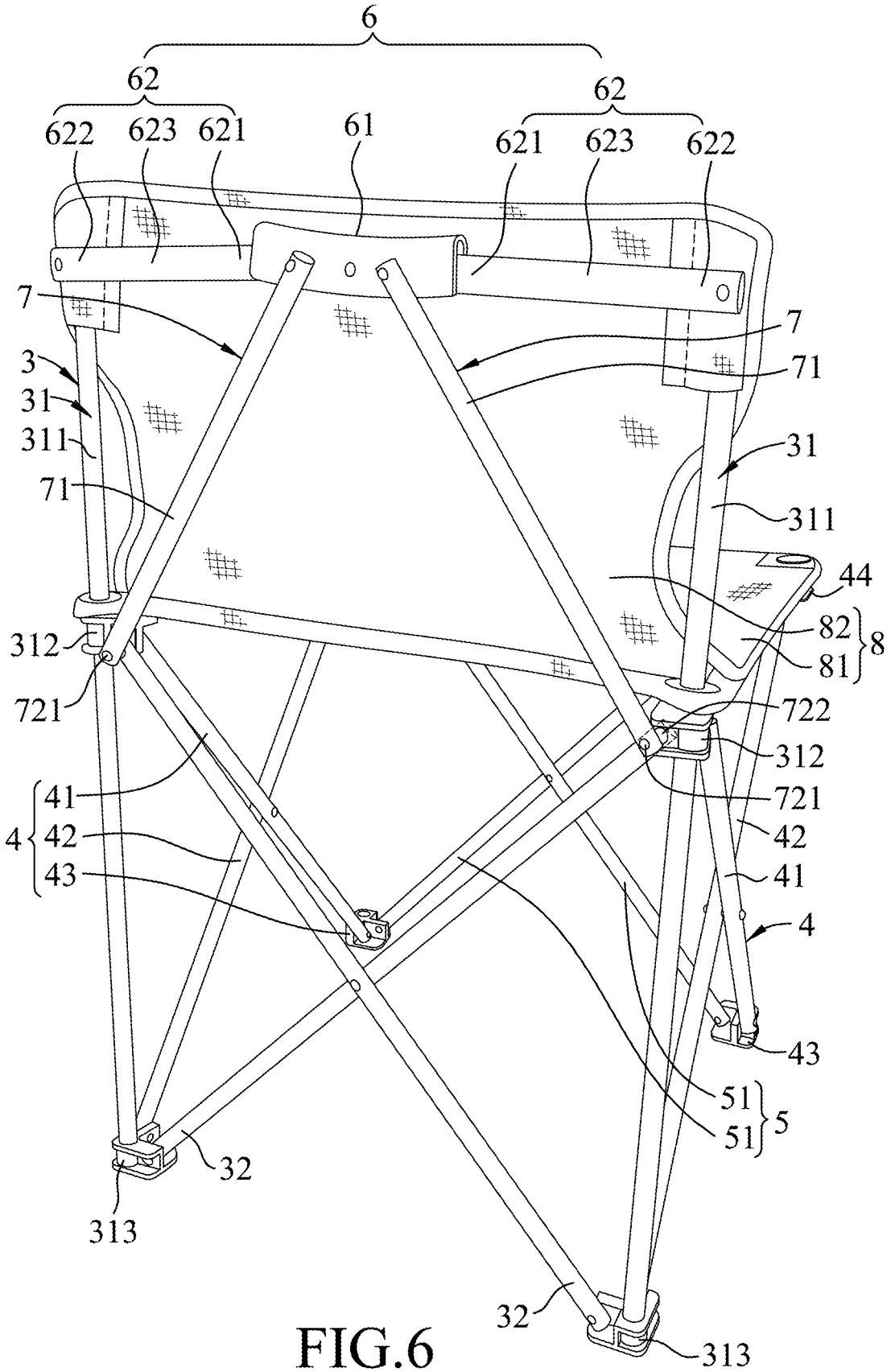
FIG. 6 is another perspective view of the first embodiment viewed from a different angle in the stretched state.
Figure 7:
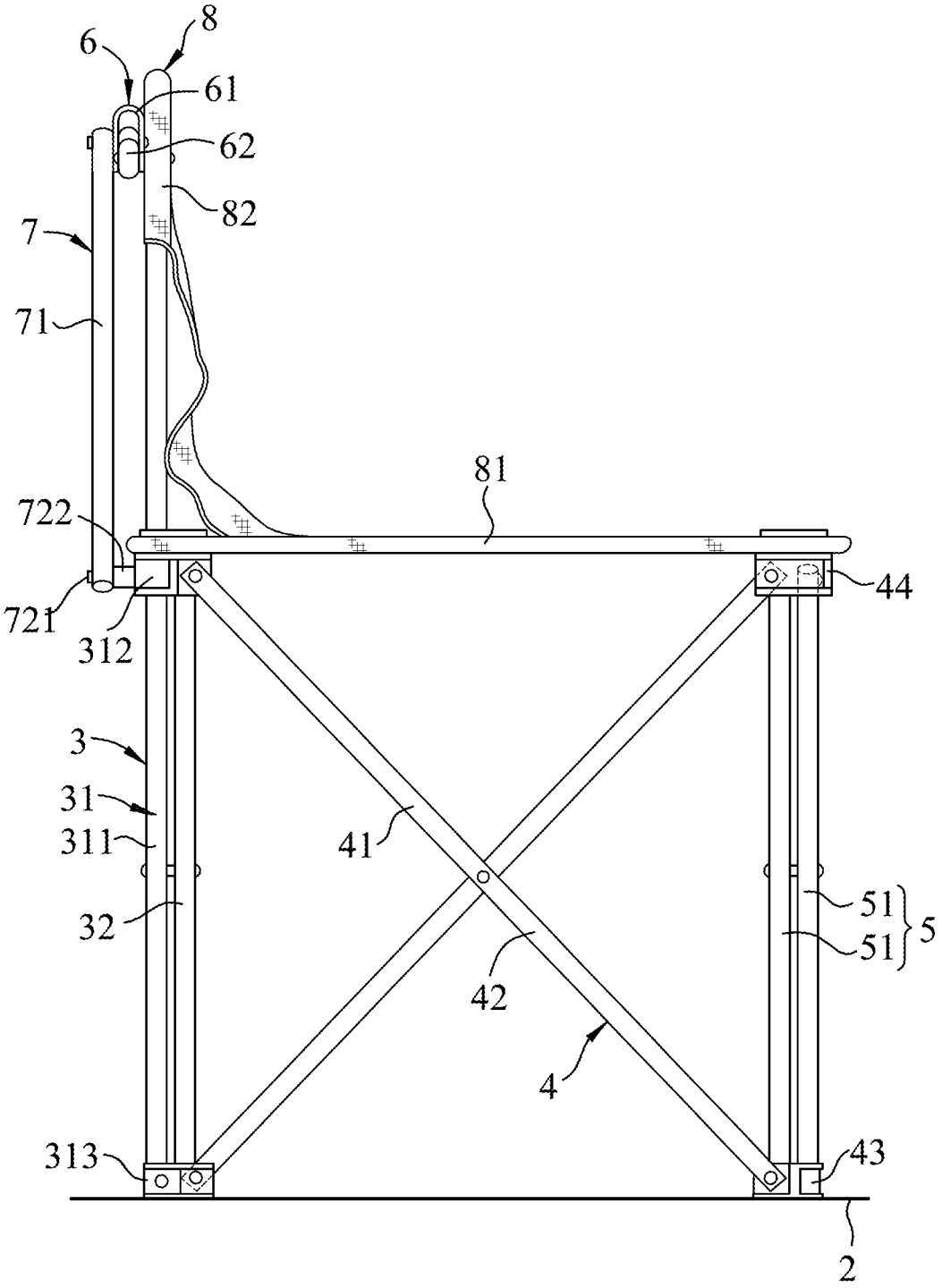
FIG. 7 is a side view of the first embodiment in the stretched state.

FIGS. 5 to 7 illustrate a foldable chair according to a first embodiment of the disclosure placed on a support surface 2 such as a floor.

In this embodiment, the foldable chair includes a chair back unit 3, two side leg units 4, a front leg unit 5, a foldable rod unit 6, two linking rod units 7, and a chair cover unit 8.

The chair back unit 3 includes two back rod sets 31 that are spaced apart from each other in a left-right direction, and two back legs 32.

Each back rod set 31 has a back rod 311 that extends in a top-bottom direction perpendicular to the left-right direction, an upper sleeve 312 that is slidably sleeved on the back rod 311, and a lower sleeve 313 that is sleeved on a bottom end of the back rod 311.

The back legs 32 are arranged in a front-rear direction perpendicular to the left-right direction and the top-bottom direction, and are crossed over and pivotally connected to each other. Each of the back legs 32 has a top end that is pivotally connected to the upper sleeve 312 of a respective one of the back rod sets 31, and a bottom end that is pivotally connected to the lower sleeve 313 of another one of the back rod sets 31.

The side leg units 4 are disposed in front of the chair back unit 3, and are spaced apart from each other in the left-right direction. Each of the side leg units 4 includes first and second scissor legs 41, 42 that are arranged in the left-right direction and that are crossed over and pivotally connected to each other, a bottom pivot seat 43 that is disposed in front of the lower sleeve 313 of a respective one of the back rod sets 31, and a upper pivot seat 44 that is disposed in front of the upper sleeve 312 of the respective one of the back rod sets 31.

For each side leg unit 4, the first scissor leg 41 extends diagonally and has opposite top and bottom ends that are pivotally and respectively connected to the upper sleeve 312 of the respective one of the back rod sets 31 and the bottom pivot seat 43. The second scissor leg 42 extends diagonally and has opposite top and bottom ends that are pivotally and respectively connected to the upper pivot seat 44 and the lower sleeve 313 of the respective one of the back rod sets 31.

As shown in FIG. 7, the bottom pivot seats 43 of the side leg units 4 and the lower sleeves 313 of the back rod sets 31 are disposed on the support surface 2 such that the chair back unit 3 and the side leg units 4 can stand on the support surface 2 when the foldable char is in use.

The front leg unit 5 includes two front legs 51 that are arranged in the front-rear direction and that are crossed over and pivotally connected to each other. Each front leg 51 has a top end that is pivotally connected to the upper pivot seat 44 of a respective one of the side leg units 4, and a bottom end that is pivotally connected to the bottom pivot seat 43 of another one of the side leg units 4.

It is noted that those pivot connections between the back legs 32 and the upper sleeves 312, between the back legs 32 and the lower sleeves 313, between the first scissor legs 41 and the upper sleeves 312, between the first scissor legs 41 and the bottom pivot seats 43, between the second scissor legs 42 and the lower sleeves 313, between the second scissor legs 42 and the upper pivot seats 44, between the front legs 51 and the bottom pivot seats 43, and between the front legs 51 and the upper pivot seats 44 may be implemented in various known ways, and are not limited by the disclosure.

The foldable rod unit 6 is pivotally connected between the back rods 311 of the back rod sets 31, is operable to move the back rods 311 of the back rod sets 31 toward or away from each other, and includes a hinge seat 61 and two connecting rods 62.

The hinge seat 61 is disposed between the back rods 311 of the back rod sets 31. Each connecting rod 62 has a first end portion 621 that is pivotally connected to the hinge seat 61, a second end portion 622 that is opposite to the first end portion 621 and that is pivotally connected to the back rod 311 of a respective one of the back rod sets 31, and an intermediate portion 623 that is connected between the first and second end portions 621, 622.

Each of the linking rod units 7 has an end that is pivotally connected to the foldable rod unit 6, and another end that is pivotally connected to the chair back unit 3. Specifically, each of the linking rod units 7 includes a linking rod 71 that has a top end pivotally connected to the hinge seat 61, and a bottom end pivotally connected to the upper sleeve 312 of a respective one of the back rod sets 31.

It is noted that the pivot connections between each linking rod 71 and the upper sleeve 312 of the respective one of the back rod sets 31 may be implemented in different ways, and specific ways of implementing the pivot connections therebetween are not limited to the disclosure. For example, as shown in FIG. 6, in the left side of the foldable chair (viewed from the rear side), the corresponding linking rod 71, the corresponding back leg 32, and the corresponding upper sleeve 312 are sequentially arranged from rear to front, and are interconnected via a pivot pin 721 extending therethrough. Alternatively, in the right side of the foldable chair, the corresponding linking rod 71, the corresponding upper sleeve 312, and the corresponding back leg 32 are exemplified to be sequentially arranged from rear to front, and are interconnected via another pivot pin 721 extending therethrough, with a pad 722 sandwiched between the corresponding linking rod 71 and the corresponding upper sleeve 312.

The chair cover unit 8 includes a seat cover 81 and a backrest cover 82. The seat cover 81 has left and right front ends that are respectively secured to the upper pivot seats 44 of the side leg units 4, and left and right rear ends that are respectively disposed above the upper sleeves 312 of the back rod sets 31 and that are respectively and slidably sleeved on the back rods 311 of the back rod sets 31. The backrest cover 82 is integrally connected to the seat cover 81 and is connected to the back rods 311 of the back rod sets 31.

Figure 8:
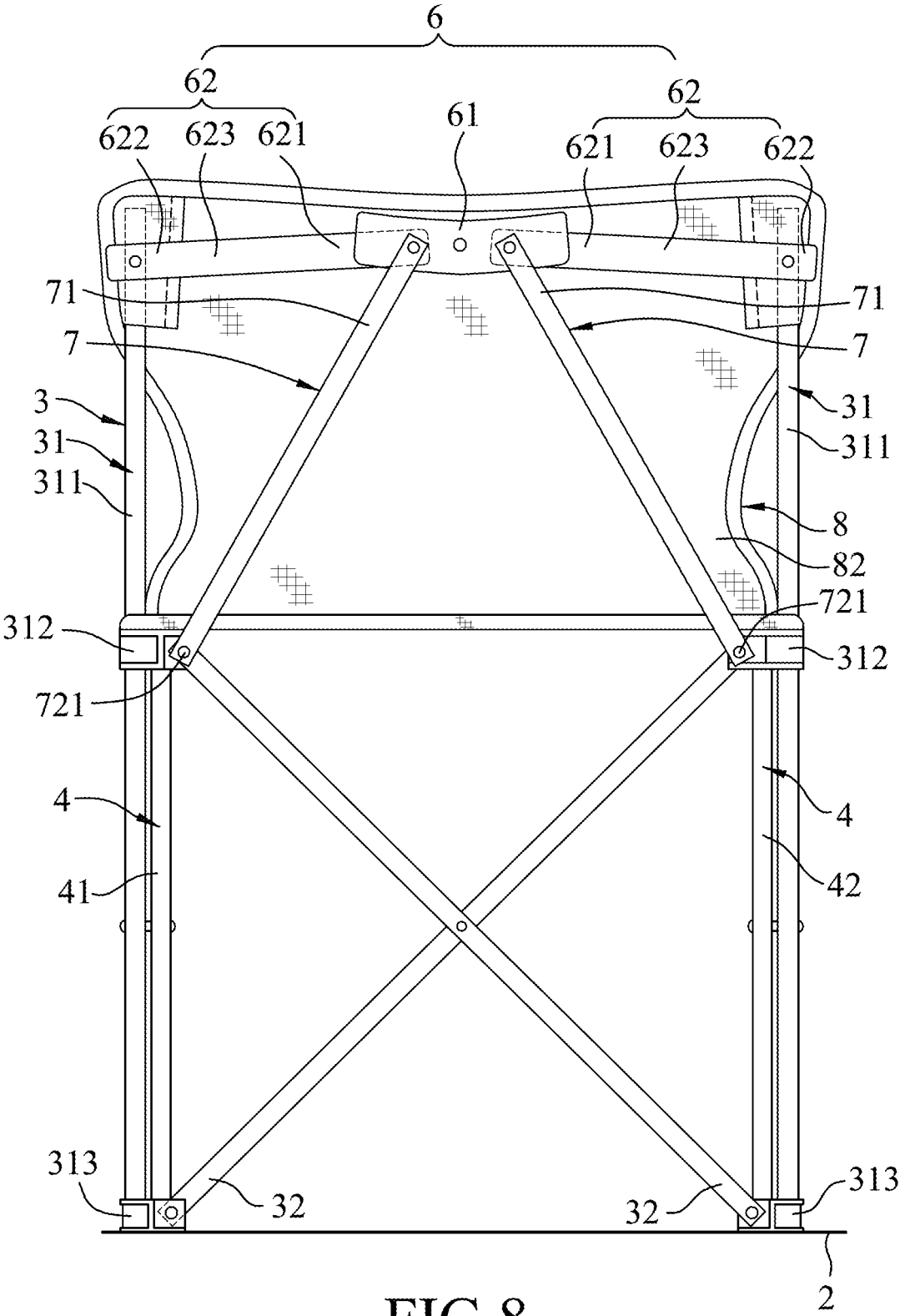
FIG. 8 is a rear view of the first embodiment in the stretched state.
Figure 9:
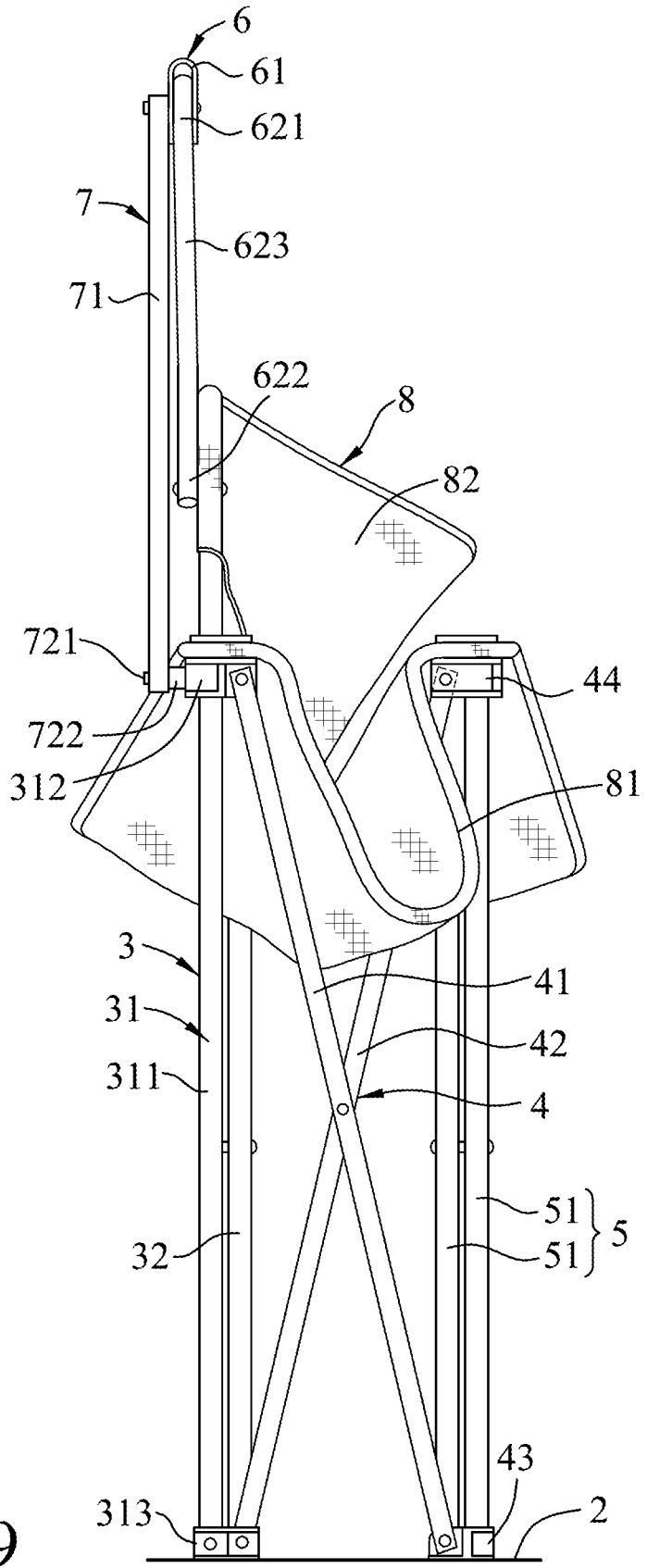
FIG. 9 is a side view of the first embodiment in a folded state.
Figure 10:
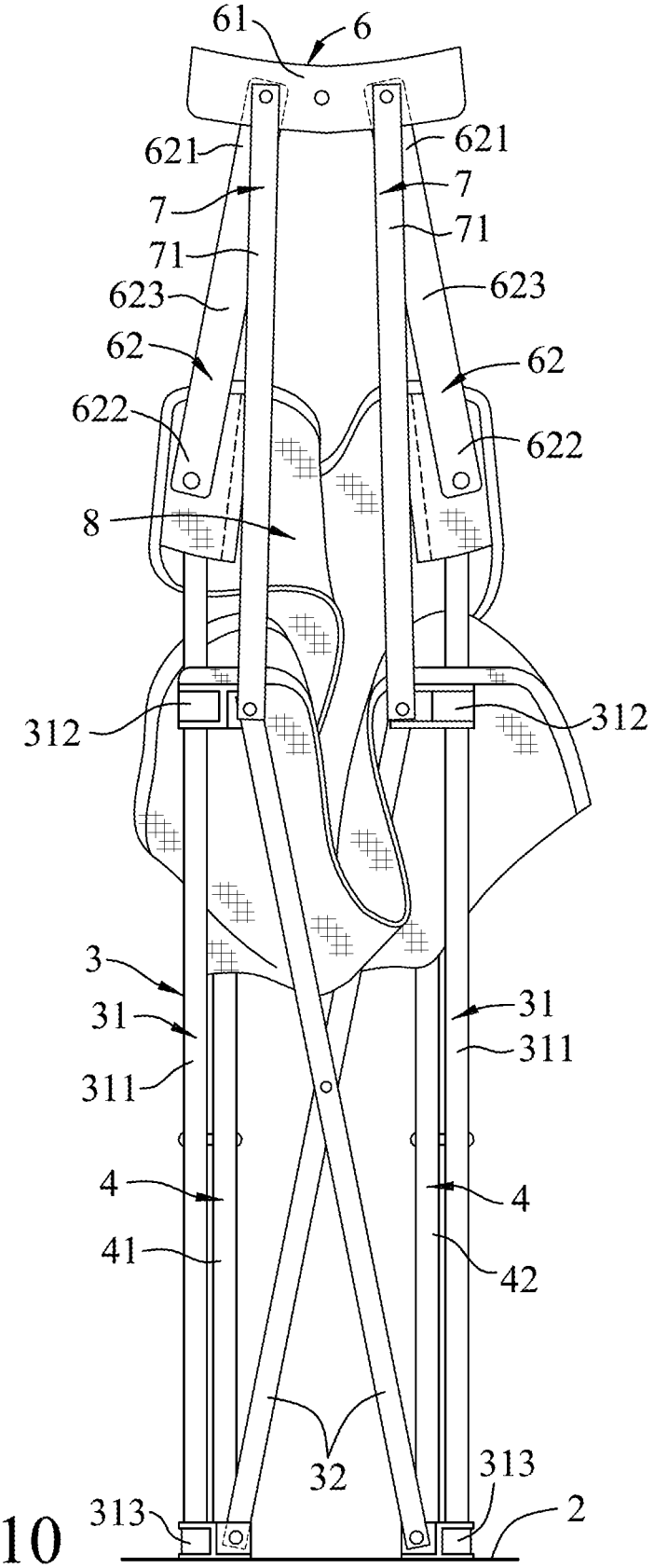
FIG. 10 is a rear view of the first embodiment in the folded state.

The foldable chair of the disclosure is operable to change between a stretched state (see FIGS. 7 and 8) and a folded state (see FIGS. 9 and 10).

As shown in FIGS. 6 to 8, in the stretched state, the hinge seat 61 and the connecting rods 62 extend in a line in the left-right direction between the back rods 311 of the back rod sets 31; the linking rods 71 of the linking rod units 7 are inclined relative to the top-bottom direction; each pair of the back legs 32, the first and second scissor legs 41, 42, and the front legs 51 are orthogonally and respectively crossed; and each of the upper sleeves 312 is approximately located at a midpoint of the corresponding back rod 311.

To operate the foldable chair from the stretched state to the folded state, a user may pull the hinge seat 61 downwardly to move the back rods 311 of the back rod sets 31 toward each other and to fold the back legs 32.

Referring to FIGS. 9 and 10, in the folded state, the hinge seat 61 and the connecting rods 62 cooperate with each other to form an inverted U-shaped structure; the linking rods 71 of the linking rod units 7 extend in the top-bottom direction and are parallel to each other; each pair of the back legs 32, the first and second scissor legs 41, 42, and the front legs 51 are respectively crossed with an angle between upper portions thereof being at an acute angle less than 30°; and each of the upper sleeves 312 is located between the midpoint and a top end of the corresponding back rod 311.

According to the foldable chair of the disclosure, by virtue of the cooperation among the foldable rod unit 6, the linking rod units 7, and the chair back unit 3, the user can easily and smoothly operate the foldable chair to change between the stretched state and the folded state.

Figure 11:
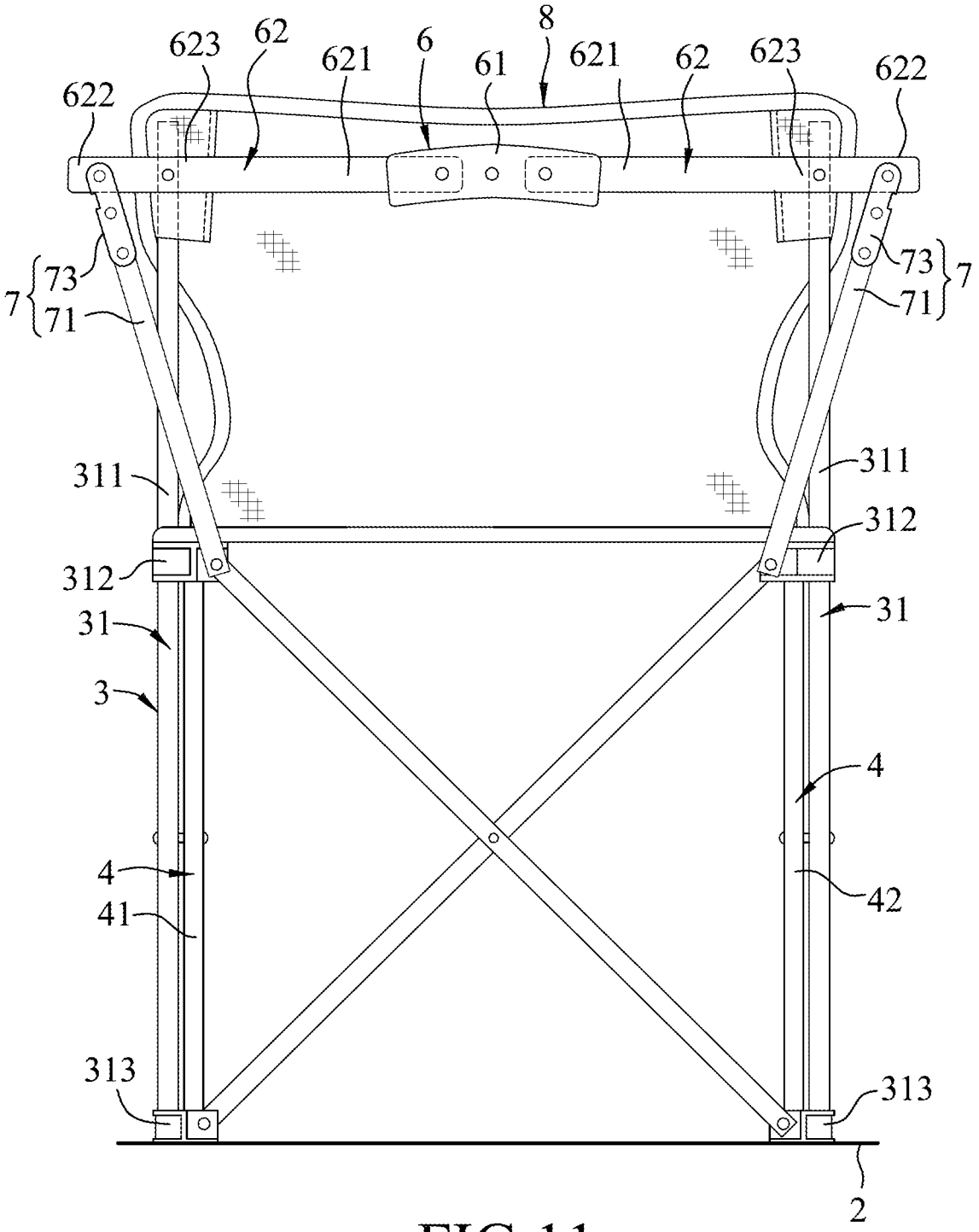
FIG. 11 is a rear view illustrating a foldable chair according to a second embodiment of the disclosure in a stretched state.
Figure 12:
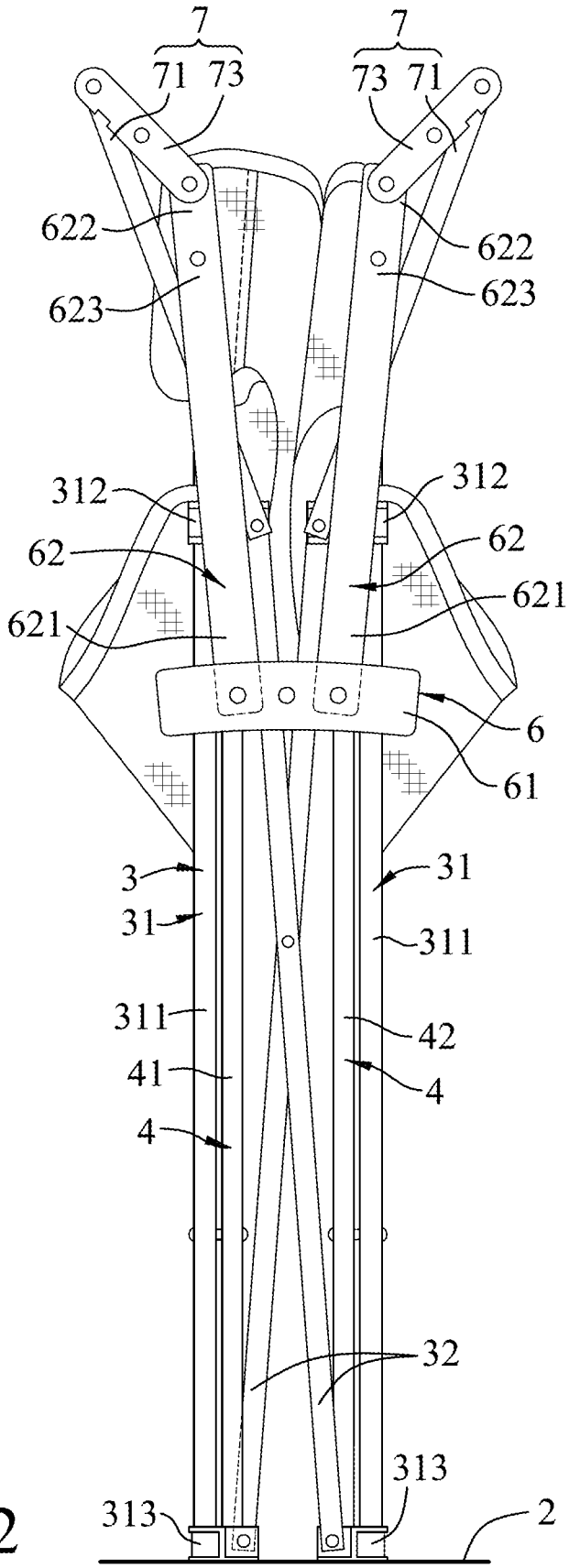
FIG. 12 is a rear view of the second embodiment in a folded state.

FIGS. 11 and 12 illustrate a foldable chair according to a second embodiment of the disclosure, which has a structure generally similar to that of the first embodiment. However, in this embodiment, the intermediate portion 623 of each connecting rod 62 is pivotally connected to the back rod 311 of a respective one of the back rod sets 31, such that the second end portion 622 of each connecting rod 62 protrudes outwardly from the back rod 311 of the respective back rod set 31. The linking rods 71 of the linking rod units 7 are not directly connected to the connecting rods 62. Specifically, in this embodiment, each of the linking rod units 7 further includes a connecting member 73 having a top end that serves as the top end of the linking rod unit 7, and that is pivotally connected to the second end portion 622 of the corresponding connecting rod 62. The linking rod 71 of the linking rod unit 7 is connected pivotally to a bottom end of the connecting member 71, and has a bottom end serving as the bottom end of the linking rod unit 7. The linking rod 71 has a length that is longer than that of the connecting member 73.

As shown in FIG. 11, in the stretched state, the hinge seat 61 and the connecting rods 62 extend in a line in the left-right direction; and the linking rod 71 and the connecting member 73 of each linking rod unit 7 extend in the same direction that it is inclined relative to the top-bottom direction.

To operate the foldable chair from the stretched state to the folded state, the user may pull the hinge seat 61 downwardly to move the back rods 311 of the back rod sets 31 toward each other and to fold the back legs 32.

Referring to FIG. 12, in the folded state, the hinge seat 61 and the connecting rod 62 cooperate with each other to form a substantially V-shaped structure; the linking rods 71 of the linking rod units 7 are inclined relative to the top-bottom direction; and the connecting members 73 of the linking rod units 7 are also inclined relative to the top-bottom direction, but the inclinations are different between the linking rods 71 and the connecting members 73.

Figure 13:
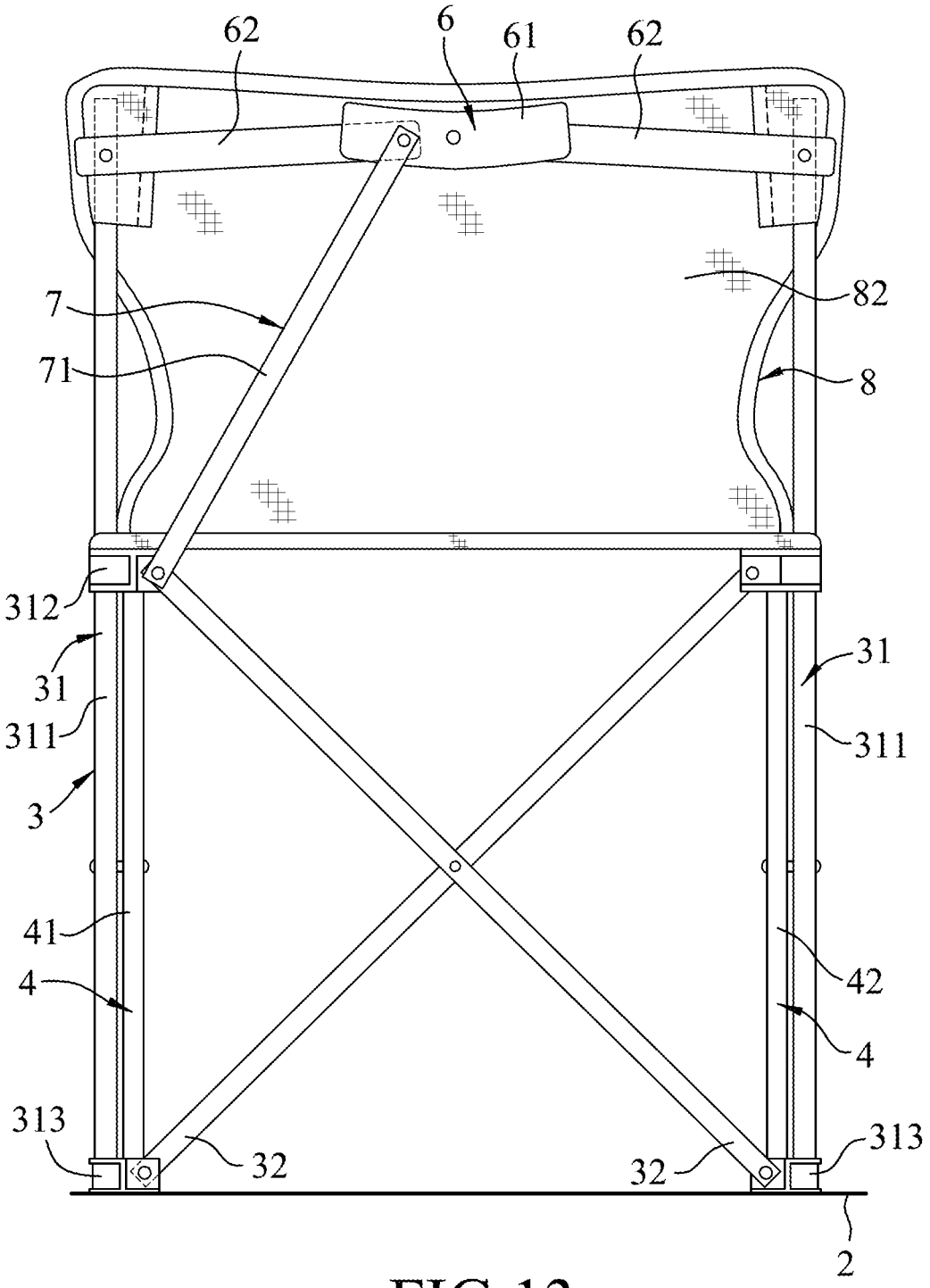
FIG. 13 is a rear view illustrating a foldable chair according to a third embodiment of the disclosure in a stretched state.

FIG. 13 illustrate a foldable chair according to a third embodiment of the disclosure, which has a structure generally similar to that of the first embodiment. However, in this embodiment, the foldable chair includes only one linking rod unit 7. Because the foldable chair includes only one linking rod unit 7, the foldable chair of this embodiment can be made more lightweight and economical compared to the foldable chair of the first embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A foldable chair comprising:

a chair back unit including two back rod sets spaced apart from each other in a left-right direction, each of said back rod sets having a back rod that extends in a top-bottom direction perpendicular to the left-right direction, an upper sleeve that is slidably sleeved on said back rod, and a lower sleeve that is sleeved on a bottom end of said back rod;

two side leg units spaced apart from each other in the left-right direction, each of said side leg units including first and second scissor legs that are arranged in the left-right direction and that are crossed over and pivotally connected to each other, a bottom pivot seat that is disposed in front of said lower sleeve of a respective one of said back rod sets, and an upper pivot seat that is disposed in front of said upper sleeve of the respective one of said back rod sets, said first scissor leg having opposite top and bottom ends that are pivotally and respectively connected to said upper sleeve of the respective one of said back rod sets and said bottom pivot seat, said second scissor leg having opposite top and bottom ends that are pivotally and respectively connected to said upper pivot seat and said lower sleeve of the respective one of said back rod sets;

a chair cover unit including a seat cover that has left and right front ends respectively secured to said upper pivot seats of said side leg units, and left and right rear ends respectively disposed above said upper sleeves of said back rod sets and respectively and slidably sleeved on said back rods of said back rod sets;

a foldable rod unit pivotally connected between said back rods of said back rod sets and operable to move said back rods of said back rod sets toward or away from each other; and at least one linking rod unit having an end that is pivotally connected to said foldable rod unit, and another end that is pivotally connected to said chair back unit.

2. The foldable chair as claimed in claim 1, wherein said foldable rod unit includes a hinge seat and two connecting rods, said hinge seat being disposed between said back rods of said back rod sets, each of said connecting rods having a first end portion that is pivotally connected to said hinge seat, a second end portion that is opposite to said first end portion, and an intermediate portion that is connected between said first and second end portions.

3. The foldable chair as claimed in claim 2, wherein said second end portion of each of said connecting rods is pivotally connected to said back rod of a respective one of said back rod sets, said at least one linking rod unit having a top end that is pivotally connected to said hinge seat, and a bottom end that is pivotally connected to said upper sleeve of one of said back rod sets.

4. The foldable chair as claimed in claim 2, wherein said intermediate portion of each of said connecting rods is pivotally connected to said back rod of a respective one of said back rod sets, said second end portion of each of said connecting rods protruding outwardly from said back rod of said respective one of said back rod sets, said at least one linking rod unit including two linking rod units, each having a top end pivotally connected to said second end portion of a respective one of said connecting rods, and a bottom end pivotally connected to said upper sleeve of a respective one of said back rod sets.

5. The foldable chair as claimed in claim 4, wherein each of said linking rod units includes a connecting member having said top end of said linking rod unit, and a linking rod pivotally connected to said connecting member and having said bottom end of said linking rod unit, said linking rod having a length that is longer than that of said connecting member.

6. The foldable chair as claimed in claim 1, wherein said chair back unit further includes two back legs that are arranged in a front-rear direction perpendicular to the left-right direction and the top-bottom direction and that are crossed over and pivotally connected to each other, each of said back legs having a top end that is pivotally connected to said upper sleeve of a respective one of said back rod sets, and a bottom end that is pivotally connected to said lower sleeve of another one of said back rod sets.

7. The foldable chair as claimed in claim 1, further comprising a front leg unit including two front legs that are arranged in a front-rear direction perpendicular to the left-right direction and the top-bottom direction and that are crossed over and pivotally connected to each other, each of said front legs having a top end that is pivotally connected to said upper pivot seat of a respective one of said side leg units, and a bottom end that is pivotally connected to said bottom pivot seat of another one of said side leg units.

8. The foldable chair as claimed in claim 1, wherein said chair cover unit further includes a backrest cover integrally connected to said seat cover and connected to said back rods of said back rod sets.

* * * * *